United States Patent [19]

Jones

[11] 3,956,750

[45] May 11, 1976

[54] PORTABLE ANTENNA FOR USE WITHIN A VEHICLE

[76] Inventor: Warren S. Jones, 737 N. Seward St., Los Angeles, Calif. 90038

[22] Filed: Jan. 7, 1974

[21] Appl. No.: 431,092

[52] U.S. Cl. ..... 343/712; 343/895

[51] Int. Cl.[2] ..... H01Q 1/32

[58] Field of Search ..... 343/702, 711, 712, 720, 343/841, 895

[56] References Cited

UNITED STATES PATENTS

| | | | |
|---|---|---|---|
| 2,520,986 | 9/1950 | Williams et al. | 343/712 |
| 2,963,704 | 12/1960 | Yates et al. | 343/895 |
| 2,966,679 | 12/1960 | Harris | 343/895 |
| 3,267,476 | 8/1966 | Finke | 343/715 |
| 3,717,876 | 2/1973 | Volkers et al. | 343/712 |

*Primary Examiner*—Eli Lieberman

*Attorney, Agent, or Firm*—William C. Babcock

[57] ABSTRACT

A portable device capable of being removably supported within the metal passenger carrying body of an automobile vehicle to receive high and low frequency short wave radio signals when the vehicle is in the line of sight area in which such signals are broadcast. The body of the vehicle becomes alternately charged by the broadcast electromagnetic signals, and as a result thereof emanates secondary electromagnetic waves. The present device is disposed adjacent to the interior surface of the body but electrically insulated therefrom. The device when so disposed has the secondary electromagnetic waves pass through a helically wound coil of wire that forms a part thereof, and the secondary waves in so doing generating an electric current in the coil of sufficient magnitude as to be subsequently amplified by the radio and transformed into audible sound waves.

4 Claims, 3 Drawing Figures

PORTABLE ANTENNA FOR USE WITHIN A VEHICLE

BACKGROUND OF THE INVENTION

1. Field of the Invention

Portable Radio Signal Receiving Device and Method of Using Same.

2. Description of the Prior Art

In the past the reception of radio signals in the 30 to 174 MHz range has been possible in an automotive vehicle only by mounting a whip type antenna in an upwardly extended position on the exterior thereof. The mounting of such an antenna not only requires the defacing of the vehicle, but renders the vehicle unattractive after the antenna is so mounted.

The metallic mass of the passenger carrying portion of the present day automotive vehicle has been considered a shield that would prevent the reception of high frequency radio signals within the interior thereof.

The applicant in devising the present invention has found that the metallic passenger carrying portion of an automotive vehicle serves as a collector of electromagnetic radio waves in the 30 to 174 MHz range and becomes alternately charged as a result thereof. The metallic automotive body as a result of such alternate charging emits secondary electromagnetic waves at least to the interior thereof, and that these secondary waves by the present portable invention when the latter is situated within the body and adjacent to an interior surface thereof may be detected and amplified by a radio to be transformed into audible sound waves. The radio of course, must be of a type that can be tuned to a desired portion of the electromagnetic radio waves within the 30 to 174 MHz spectrum.

A major object of the present invention is to provide a compact lightweight assembly that may be disposed within the confines of the passenger carrying metallic body portion of an automotive vehicle, and when so disposed adjacent the interior surface of the body but electrically insulated therefrom will generate an electric current from secondary electromagnetic waves of sufficient magnitude that they may be amplified be a radio and transformed into audible sound waves.

Another object of the present invention is to supply a portable device that is removably positionable within the confines of the metallic body portion of an automobile, boat or airplane to permit the reception of radio signals in the high and low frequencies when the vehicle is in a line of sight area, and such reception being achieved without the use or assistance of an external antenna.

A still further object of the invention is to permit a radio sensitive to signal in the 30 to 174 MHz range to be used immediately after installation in a vehicle and without waiting for an external antenna to be installed which is not only expensive but permanently defaces the vehicle on which it is installed.

SUMMARY OF THE INVENTION

The invention is an assembly that includes an elongate rigid member formed from an electrical insulating material on which a coil of electrical conducting wire is wound in a helical configuration with the turns spaced from one another. A first end of the coil is permanently secured to the elongate member and the second end being connected to a small inductance coil that is also mounted on the elongate member. The inductance coil is connected to a lead in cable that is provided on the free end thereof with a prong to permit it to be connected to a radio that is capable of receiving radio signals within the 30 to 174 MHz range.

The invention is used by placing it within the metallic body of the vehicle and supporting it in an electrically insulated position adjacent the interior surface thereof. Electromagnetic radio waves within the above described range are considered to impinge on the metallic vehicle body to alternately charge the same, and this alternate charging resulting in the metallic body emitting secondary electromagnetic waves that pass through the helical wound coil and generate an electric current therein of sufficient magnitude as to be amplified by the radio and transformed into audible sound waves.

The inductance coil and impedance of the lead in cable are matched. The precise theory as to why the invention operates satisfactory is not completely understood, nor is the mathematical relationship as to the number of turns of the helical wound coil that must be provided to receive radio signals in a particular range. One anomaly that has developed in that the number of turns in the helical wound coil must be increased with an increase in the frequency of the radio signal that is to be received. Thus, if the invention is to receive radio signals in the 148–174 MHz range a greater number of turns will be required in the helical wound coil than for reception in the 30–50 MHz range.

DESCRIPTION OF THE PREFERRED EMBODIMENT

Figure 1:
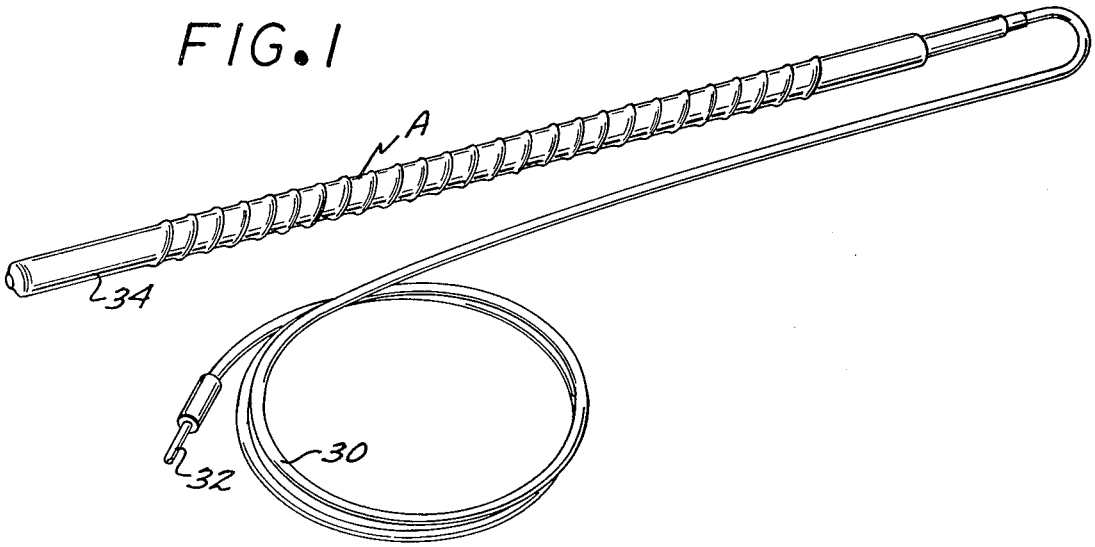
FIG. 1 is a perspective view of the portable assembly for use in receiving high and low frequency short wave radio signals when disposed adjacent the surface of a metallic body such as the passenger carrying of an automotive vehicle.

The portable radio signal receiving assembly A shown in FIG. 1 is adapted to be removably positioned on a horizontally disposed sunshade B of an automotive vehicle having a metallic body (not shown) and adjacent the interior surface of the roof C of the vehicle.

The assembly A is particularly adapted to supplying signals to a radio D that is of the scanner type, and is adapted to receive VHF High, VHF low and UHF signals or a portion thereof.

In the past it has been possible to receive radio signals for a radio of this type when disposed in a vehicle only by a whip type antenna mounted in an electrically insulated position on the exterior of the vehicle. Mounting of a whip type antenna on a vehicle normally necessitates the forming of a bolt receiving opening in the body portion thereof that permanently defaces the vehicle. Also, after a scanner type radio is mounted in a vehicle it may be days or a week before a whip type atenna can be installed on the vehicle.

The assembly A overcomes the objectional defacing of the vehicle, as well as allowing the scanner type radio to be used as soon as it is mounted or disposed in the vehicle.

Figure 2:
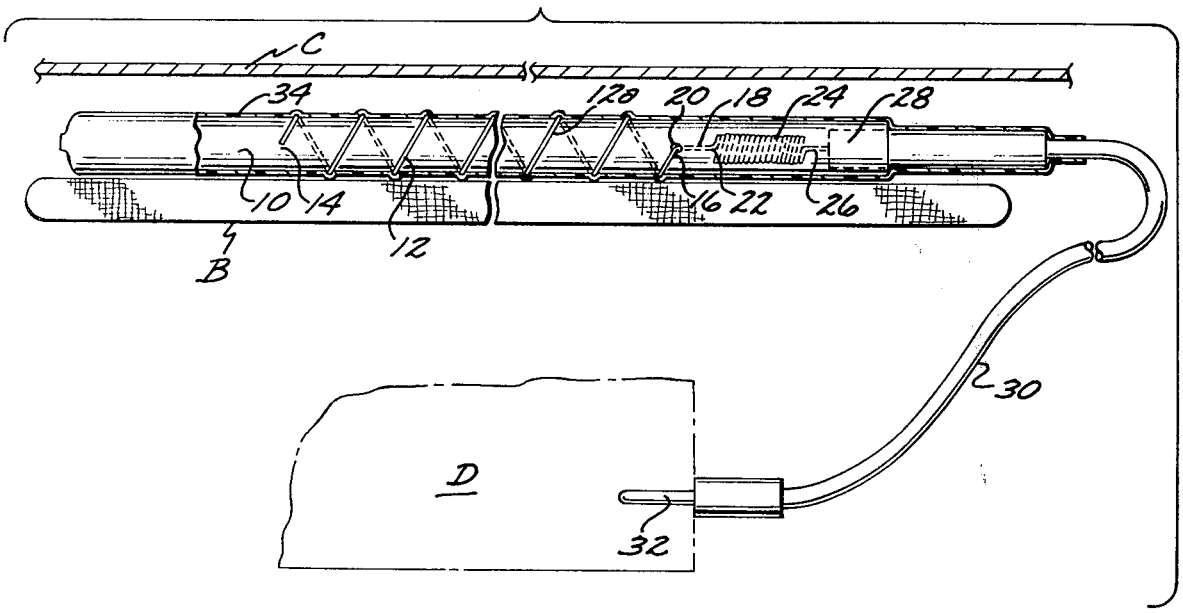
FIG. 2 is a combined side elevational and longitudinal cross sectional view of the device, with the signal receiving portion thereof resting on the sunshade of an automotive vehicle and adjacently disposed to the interior surface of the roof of the vehicle.

Assembly A as can best be seen in FIG. 2 includes an elongate member 10, preferably a tube, that is formed from an electrical insulating material. In practice a member twelve inches in length has been found to be satisfactory. The member 10 has a coil 12 of electrical conducting wire helically wound thereon, with the turns 12*a* of the coil being longitudinally spaced from one another. A first end 14 of coil 12 is rigidly secured to the member by conventional means not shown. A second end 16 of coil 12 is connected to an electrical conducting wire 18 that passes through a transverse opening 20 in member 10 and is connected to a first end 22 of an inductance coil 24. The inductance coil 24 is preferably disposed within the interior of a tube when the latter defines member 10, or if the member is solid the inductance coil can be positioned in a longitudinal cavity formed in the member. The coil 10 and inductance coil as can best be seen in FIG. 2 are coaxially aligned.

The second end 26 of inductance coil 24 is connected to a first end 28 of a radio lead in cable 30 that extends to the radio D. The inductance of coil 24 and the impedance of the radio lead in cable 30 are matched. The connection between cable 30 and radio D will normally be removable and effected by an electrical conducting prong 32. The elongate member 10 and coil 12 is preferably sheathed in a envelope 34 of a non-electrical conducting plastic that may be shrunk or otherwise be disposed in a tight fitting position thereon.

When the assembly A is disposed in a vehicle having a metallic roof C, electromagnetic radio waves from a broadcasting station (not shown) in a line of sight area cause the roof C to be alternately charged to a slight extent. The electrical charge is dissipated by the roof C emitting a second discharge of electromagnetic waves that pass through the coil 12 when the latter is adjacently disposed to the interior surface of the roof C. In practice, it has been found that the closer the coil 12 is to roof C the better, so long as the coil and roof are not in physical contact. The roof C serves as a shield to block out the primary electromagnetic radio waves passing through the coil 12, as the secondary electromagnetic waves emitted by the roof C pass through the coil 12 an electric current is generated in the latter that is of sufficient magnitude to be amplified by radio D and transformed into audible sound waves.

The precise method by which the invention operates is not fully understood. The number of turns 12*a* in the coil 12 must be determined empirically for the particular range of high or low frequency radio short waves that are to be detected and amplified by the radio D. From experience it has been found that the number of turns 12*a* must be increased as the frequency of the primary electromagnetic radio signal increases in frequency. Also, it has been found that for successful detection and amplification of radio signals that the turns 12*a* of coil 12 must be longitudinally spaced from one another.

Figure 3:
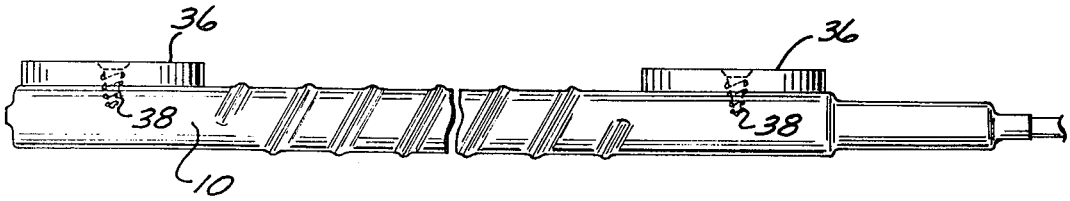
FIG. 3 is a side elevational view of an alternate form of the device.

An alternate form A′ of the assembly is shown in FIG. 3 that is identical with assembly A, other than the alternate assembly includes one or more permanent magnets 36 that permit the alternate assembly to be removably held adjacent the surface of a massive metallic body, such as the passenger carrying portion of an automotive vehicle, a steel window frame or the like. The magnets 36 are secured to elongate member 10 by screws 38 or the like.

The structure and operation of the invention has been described previously in detail and need not be repeated.

1. In combination with a metallic automotive body having openings therein, said body functioning as a primary antenna to receive radio signals having a frequency which falls within the range of VHF High, VHF low and UHF signals, and re-radiating said radio signals, a device adapted for mounting within said automotive body proximate said openings which is capable of receiving radio signals within a selected range of frequencies that emanate from said body as the latter serves as said primary antenna and directs said radio signals within said selected range to a radio of the scanner type disposed within said automotive body, said device including:

a. single elongate tubular rigid member formed from an electrical insulating material that may be disposed adjacent to, but spaced from an interior surface of said metallic automotive body;

b. a length of wire wound upon said rigid member to define a plurality of longitudinally spaced turns thereon, which length of wire has first and second ends that are secured to said elongate rigid member;

c. a lead-in cable connected to said radio, which cable has a known impedance;

d. an inductance coil disposed within said member and connected to said lead-in cable and to said second end of said wire, with said impedance and inductance being matched, which radio when turned to the frequency of signals emanating from said body to said turns of wire amplifies and fransforms said signals to audible sound waves, with said selected range being determined by the number of said turns of wire on said rigid member, and said number of turns being increased as the frequency of that portion of the said radio signals which are desired to be received increases, and removable attaching means for removably positioning said device proximate said openings.

2. A device as defined in claim 1 which further includes:

e. an envelope of electrical insulating sheet material that extends about said turns on said member.

3. A device as defined in claim 1 wherein:

e. said removable attaching means includes magnetic means for removably securing said device to an interior surface of said body.

4. A device as defined in claim 3, wherein said magnetic means are a pair of permanent magnets secured to said elongate rigid member.

* * * * *